US012747915B2

(12) United States Patent
Chen et al.

(10) Patent No.: US 12,747,915 B2
(45) Date of Patent: Sep. 29, 2026

(54) DRYING APPARATUS AND SYSTEM FOR PREPARING BATTERIES

(71) Applicant: CONTEMPORARY AMPEREX TECHNOLOGY (HONG KONG) LIMITED, Hong Kong (CN)

(72) Inventors: Guangsheng Chen, Ningde (CN); Haohao Yan, Ningde (CN); Jiancheng Cai, Ningde (CN); Ganyu Xu, Ningde (CN); Haohua Yu, Ningde (CN)

(73) Assignee: CONTEMPORARY AMPEREX TECHNOLOGY (HONG KONG) LIMITED, Hong Kong (CN)

( * ) Notice: Subject to any disclaimer, the term of this patent is extended or adjusted under 35 U.S.C. 154(b) by 455 days.

(21) Appl. No.: 18/492,423

(22) Filed: Oct. 23, 2023

(65) Prior Publication Data

US 2024/0310123 A1 Sep. 19, 2024

Related U.S. Application Data

(63) Continuation of application No. PCT/CN2023/097133, filed on May 30, 2023.

(30) Foreign Application Priority Data

Mar. 16, 2023 (CN) ..... 202320503698.3

(51) Int. Cl.
*F28C 3/04* (2006.01)

(52) U.S. Cl.
CPC ..... *F28C 3/04* (2013.01)

(58) Field of Classification Search
CPC ..... F28C 3/04
(Continued)

(56) References Cited

U.S. PATENT DOCUMENTS 1,445,423 A * 2/1923 Ulke ..... C10G 1/06 202/96
2,548,262 A * 4/1951 Hintz ..... F26B 17/1425 366/147

(Continued)

FOREIGN PATENT DOCUMENTS

AU 2005325208 B2 * 3/2012 ..... F03G 7/0252
CN 2655141 Y 11/2004

(Continued)

OTHER PUBLICATIONS

International Search report for PCT application No. PCT/CN2023/097133, dated Nov. 16, 2023.

(Continued)

*Primary Examiner* — Stephen M Gravini
(74) *Attorney, Agent, or Firm* — Ladas & Parry LLP

(57) ABSTRACT

The present application relates to a drying apparatus and a system for preparing batteries. The drying apparatus includes a drying tower and a cooling mechanism. The cooling mechanism is disposed on the drying tower, and the cooling mechanism is used for cooling the inner wall of the drying tower, so that the temperature of the inner wall of the drying tower is controlled within the required temperature range. In this way, when the drying tower performs spray drying operation, after the material is in contact with the inner wall of the drying tower, the phenomenon that the material melts because of a high temperature of the inner wall and adheres to the inner wall is avoided. This reduces the probability of the material hanging on the wall, thereby improves the production rate and granulation quality of the material.

12 Claims, 4 Drawing Sheets

(58) Field of Classification Search
USPC ..... 34/569
See application file for complete search history.

(56) References Cited

U.S. PATENT DOCUMENTS

| | | | | | |
|---|---|---|---|---|---|
| 5,596,817 | A * | 1/1997 | Hansen | F26B 3/12 | 34/373 |
| 5,685,089 | A * | 11/1997 | Getler | F26B 3/08 | 34/372 |
| 6,151,798 | A * | 11/2000 | Petersen | B01D 1/18 | 34/304 |
| 8,601,714 | B2 * | 12/2013 | Morrison | F26B 17/124 | 34/174 |
| 8,966,783 | B2 * | 3/2015 | Kitamura | F26B 3/12 | 34/372 |
| 12,130,083 | B1 * | 10/2024 | Goldberg | F26B 3/12 | |
| 12,422,189 | B2 * | 9/2025 | Sun | A23N 17/004 | |
| 12,535,271 | B2 * | 1/2026 | Wingard | F26B 17/122 | |
| 12,571,587 | B2 * | 3/2026 | Erickson | F26B 3/12 | |
| 2010/0242516 | A1 * | 9/2010 | Seo | F28C 1/16 | 165/96 |
| 2024/0310123 | A1 * | 9/2024 | Chen | F26B 3/12 | |

FOREIGN PATENT DOCUMENTS

| | | | | | |
|---|---|---|---|---|---|
| CN | 201519568 | U | | 7/2010 | |
| CN | 103417376 | A | | 12/2013 | |
| CN | 105363231 | A | | 3/2016 | |
| CN | 206081677 | U | | 4/2017 | |
| CN | 108325226 | A | | 7/2018 | |
| CN | 207907658 | U | | 9/2018 | |
| CN | 209714315 | U | | 12/2019 | |
| CN | 111637728 | A | | 9/2020 | |
| CN | 213724882 | U | | 7/2021 | |
| CN | 215822371 | U | | 2/2022 | |
| EP | 4454728 | A1 | * | 10/2024 | F26B 21/35 |
| FR | 889439 | A | | 1/1944 | |
| JP | 51-16530 | U | | 7/1974 | |
| JP | 3026354 | U | | 7/1996 | |
| JP | 2025515238 | A | * | 5/2025 | F26B 21/35 |
| KR | 20240140786 | A | * | 9/2024 | F26B 21/35 |

OTHER PUBLICATIONS

Notice of Reasons for Refusal, JP application No. 2023-568344, dated Jul. 2, 2025.
Extended European Search Report for EP application No. 23792850.2, dated Oct. 4, 2025.

* cited by examiner

DRYING APPARATUS AND SYSTEM FOR PREPARING BATTERIES

CROSS-REFERENCE TO RELATED APPLICATIONS

The present application is a continuation of International Patent Application No. PCT/CN2023/097133, filed on May 30, 2023, which claims priority to Chinese Patent Application No. 202320503698.3, filed on Mar. 16, 2023. The aforementioned patent applications are incorporated by reference in their entirety.

TECHNICAL FIELD

The present application relates to the technical field of drying devices, and in particular, to a drying apparatus and a system for preparing batteries.

BACKGROUND

Spray drying refers to the process of blowing hot air into a drying tower from a tower opening to be in contact with an atomized material, so that the moisture in the material is quickly removed. However, during the atomization drying process, the material is likely to adhere to the inner wall of the drying tower, and the phenomenon that the material hangs on the wall occurs, which affects the output rate and granulation quality of the material.

SUMMARY

Based on this, it is necessary to provide a drying apparatus and a system for preparing batteries to reduce the probability of a material hanging on the wall and improve the output rate and granulation quality of the material.

In the first aspect, the present application provides a drying apparatus. The apparatus includes: a drying tower; and a cooling mechanism, disposed on the drying tower, for cooling the inner wall of the drying tower, where, the cooling mechanism includes reinforcing members and a cooling member disposed on the outer wall of the drying tower, and each reinforcing member is at least partially connected between the cooling member and the outer wall of the drying tower.

In the above-mentioned drying apparatus, the cooling mechanism is disposed on the drying tower, and the cooling mechanism is used for cooling the inner wall of the drying tower, so that the temperature of the inner wall of the drying tower is controlled within the required temperature range. In this way, when the drying tower performs spray drying operation, after the material is in contact with the inner wall of the drying tower, the phenomenon that the material melts because of a high temperature of the inner wall and adheres to the inner wall is avoided. This reduces the probability of the material hanging on the wall, thereby improving the production rate and granulation quality of the material. At the same time, the reinforcing member is disposed between the cooling member and the drying tower to increase the connection strength between the cooling member and the drying tower. This makes the mounting structure of the cooling member on the drying tower more stable, and facilitating stably cooling the drying tower by a cooling medium in the cooling member; at the same time it is also beneficial to increase the strength of the drying tower.

In some embodiments, the cooling mechanism includes a power source and a cooling member disposed on the outer wall of the drying tower. The cooling member has a cooling channel inside, and the power source is used for driving the cooling medium to flow in the cooling channel. In this way, the power source is used for driving the cooling medium to flow in the cooling channel, so as to enable the cooling medium to exchange heat with the drying tower, the effect of cooling the inner wall of the drying tower is realized, and the occurrence of the material hanging on the wall is reduced.

In some embodiments, the cooling member is annularly disposed on the periphery of the drying tower, and the cooling channel is formed between the cooling member and the outer wall of the drying tower. In this way, the cooling member surrounds the outside of the drying tower, so that the cooling channel is formed between the cooling member and the drying tower, and then the cooling medium flows directly on the outer wall of the drying tower, which is conducive to improving the heat exchange effect.

In some embodiments, the cooling mechanism further includes a flow equalizer annularly disposed on the periphery of the drying tower, the inflow end of the cooling channel communicates with the flow equalizer, and the power source is used for driving the cooling medium in the flow equalizer to flow into the cooling channel. In this way, the flow equalizer is disposed at the inflow end of the cooling channel, and the cooling medium is evenly dispersed into the cooling channel by the flow equalizer, so that the temperature distribution of the inner wall of the drying tower is more uniform, and the occurrence of the material hanging on the wall is further reduced. At the same time, it is also beneficial to improve the granulation quality of the material.

In some embodiments, the reinforcing member is annularly disposed on the periphery of the drying tower, and the part of the reinforcing member located in the cooling channel is provided with a circulating port, the circulating port being used for the cooling medium of the cooling channel to circulate. In this way, the circulating port penetrates through the reinforcing member, so that the cooling medium can pass through the reinforcing member to flow smoothly in the cooling channel, thereby improving the cooling effect of the drying tower.

In some embodiments, one end of the reinforcing member away from the drying tower in the radial direction of the drying tower penetrates out of the cooling member. In this way, one end of the reinforcing member penetrates out of the cooling member, so that the connection area between the reinforcing member and the cooling member increases, which is conducive to improving the connection strength. At the same time, the part of the reinforcing member penetrating into the cooling member can be used as a supporting base, so that the cooling member is more stably mounted on the drying tower.

In some embodiments, the drying tower has an air outlet, and the cooling member extends on the outer wall of the drying tower to be adjacent to the air outlet. In this way, the cooling member is extended to the air outlet, cooling at the air outlet is increased, and the outlet air temperature is reduced to meet the process requirements.

In some embodiments, the drying tower includes a first part and a second part having an air outlet. The cross-sectional area S in the second part gradually decreases from the end of the second part close to the first part to the end of the second part having the air outlet, and the cooling member is disposed on the first part and extends to the second part. In this way, extending the cooling member to the second part can increase the cooling of the second part, so that the outlet air temperature of the drying tower can be lowered, further meeting the process requirements.

In some embodiments, the cooling mechanism further includes a discharge member disposed on the drying tower, and the discharge member has discharge ports communicating with the cooling channel. In this way, the discharge member is disposed so that the cooling medium flows out from the discharge port, which facilitates the continuous flow of a new cooling medium into the cooling channel and improves the cooling effect of the drying tower.

In some embodiments, the number of the discharge ports is at least two, and all the discharge ports are disposed at intervals around the periphery of the drying tower. In this way, the discharge ports are disposed at intervals around the periphery of the drying tower, so that the cooling medium in the cooling channel flows out from different discharge ports, which is conducive to changing the flow path of the cooling medium in the cooling channel. This makes the distribution of the cooling medium more uniform, and improves the cooling effect.

In some embodiments, the drying apparatus further includes a thermal insulation layer, and the thermal insulation layer is disposed outside the cooling member in a sleeving mode. In this way, the thermal insulation layer is disposed outside the cooling member, reducing the heat loss in the cooling channel, and enabling the cooling medium to fully exchange heat with the drying tower, so that the inner wall of the drying tower can maintain the required temperature for a long time, and the probability of the material adhering to the wall due to the too high temperature of the inner wall is reduced.

In some embodiments, the drying apparatus further includes a heat exchanger, and the heat exchanger communicates with one end of the cooling member for the cooling medium to flow in. In this way, the heat exchanger exchanges heat with the cooling medium in advance to change the temperature of the cooling medium so that the cooling medium can better meet the cooling requirement of the inner wall of the drying tower.

In a second aspect, the present application provides a system for preparing batteries, including any one of the above drying apparatuses.

The above description is only a summary of the technical solutions of the present application. In order to be able to understand the technical means of the present application more clearly, the technical means can be implemented according to the content of the specification. Furthermore, to make the above and other objectives, features and advantages of the present application more comprehensible, specific implementation modes of the present application are exemplified below.

BRIEF DESCRIPTION OF DRAWINGS

Various other advantages and benefits will become apparent to those of ordinary skill in the art upon reading the following detailed description of the preferred implementation modes. The drawings are for the purpose of illustrating the preferred implementation modes only and are not to be considered as a limitation to the present application. Also, the same components are denoted by the same reference numerals in all the drawings. In the drawings.

REFERENCE SIGNS

Figure 1:
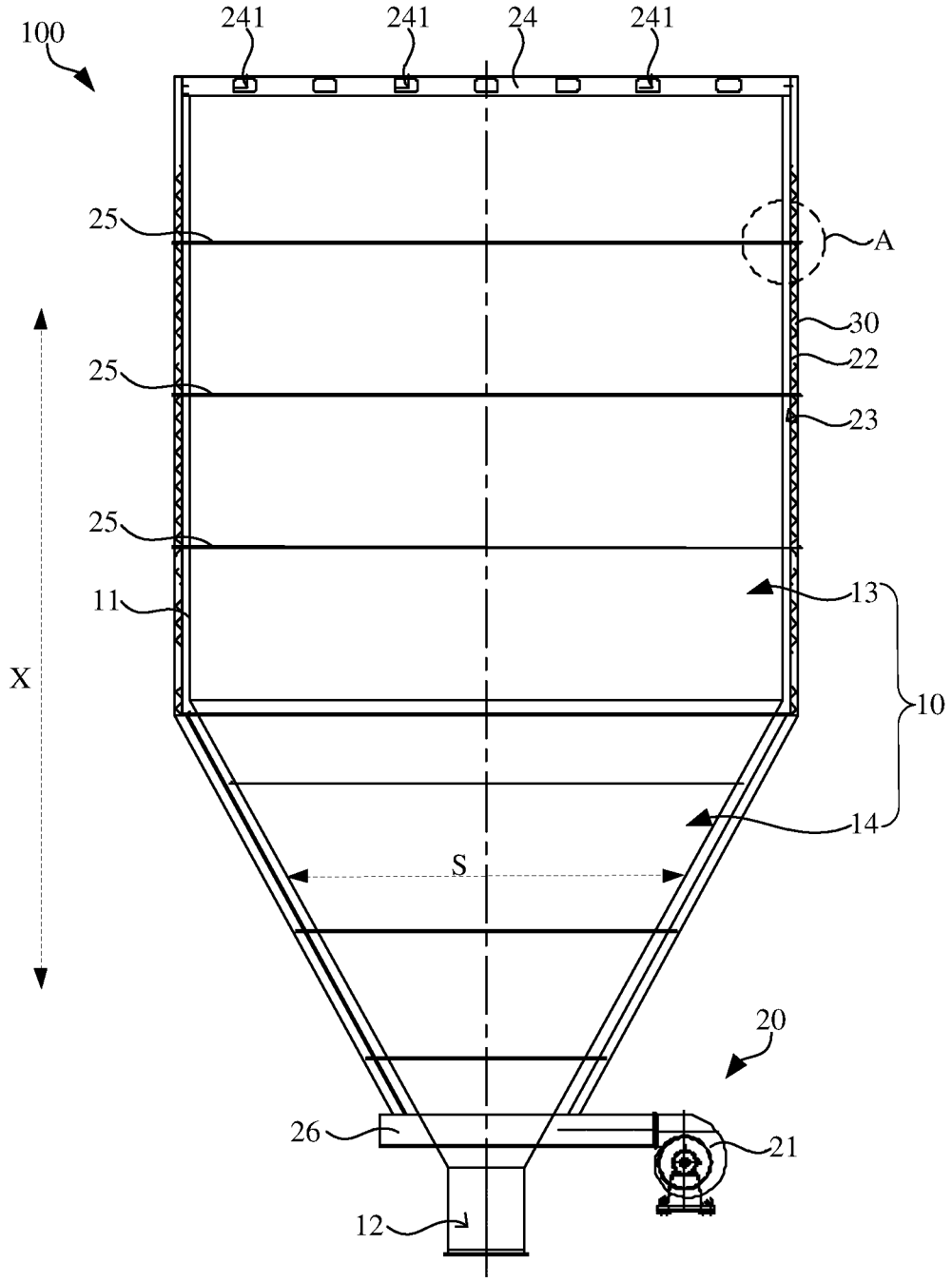
FIG. 1 is a schematic structural view of a drying apparatus according to one or more embodiments.

100. Drying apparatus;
10. Drying tower;
11. Inner wall;
12. Air outlet;
13. First part;
14. Second part;
20. Cooling mechanism;
21. Power source;
22. Cooling member;
23. Cooling channel;
24. Discharge member;
241. Discharge port;
25. Reinforcing member;
251. Circulating port;
26. Flow equalizer;
30. Thermal insulation layer;
40. Heat exchanger;
X. Height direction.

DETAILED DESCRIPTION

The technical solutions in the embodiments of the present application will be clearly and completely described below in conjunction with the drawings in the embodiments of the present application, and it is apparent that the described embodiments are a part of the embodiments of the present application rather than all the embodiments. Based on the embodiments in the present application, all other embodiments obtained by those of ordinary skill in the art without creative effort fall within the protection scope of the present application.

Unless otherwise defined, all technical and scientific terms used herein have the same meaning as commonly understood by those skilled in the art in the present application. The terms used herein are intended only for the purpose of describing specific embodiments and are not intended to limit the present application; the terms "including" and "having" and any variations thereof in the specification and the claims of the present application and in the description of the drawings above are intended to cover non-exclusive inclusion.

In the description of the embodiments of the present application, the technical terms "first", "second", and the like are used only to distinguish different objects, and are not to be understood as indicating or implying a relative importance or implicitly specifying the number, particular order, or primary and secondary relation of the technical features indicated. In the description of the embodiments of the present application, the meaning of "a plurality of" is two or more, unless otherwise explicitly and specifically defined.

Reference herein to "an embodiment" means that a particular feature, structure, or characteristic described in connection with the embodiment can be included in at least one embodiment of the present application. The appearance of this phrase in various places in the specification does not necessarily refer to the same embodiment, nor is it a separate or alternative embodiment that is mutually exclusive with other embodiments. It is explicitly and implicitly understood by those skilled in the art that the embodiments described herein may be combined with other embodiments.

In the description of the embodiments of the present application, the term "and/or" is only an association relationship for describing associated objects, indicating that there may be three relationships, for example A and/or B may represent three situations: A exists alone, both A and B exist, and B exists alone. In addition, the character "/" herein generally means that the associated objects in the context are in an "or" relationship.

In the description of the embodiments of the present application, the term "a plurality of" refers to two or more (including two), and similarly, "a plurality of groups" refers to two or more groups (including two groups), and "a plurality of pieces" refers to two or more pieces (including two pieces).

In the description of the embodiments of the present application, the orientation or position relationship indicated by the technical terms "center", "longitudinal", "transverse", "length", "width", "thickness", "upper," "lower," "front," "back," "left," "right," "vertical," "horizontal," "top," "bottom," "inner," "outer," "clockwise," "counterclockwise," "axial", "radial", "circumferential", etc. are based on the orientation or position relationship shown in the drawings and are intended to facilitate describing the embodiments of the present application and simplify the description only, rather than indicating or implying that the apparatus or element referred to must have a particular orientation or be constructed and operated in a particular orientation, and therefore are not to be interpreted as limitations on the embodiments of the present application.

In the description of the embodiments of the present application, unless otherwise expressly specified and limited, the technical terms "mount," "connect," "connection," "fix," etc. should be understood in a broad sense, such as, a fixed connection, a detachable connection, or an integral connection; a mechanical connection, or an electrical connection; a direct connection, an indirect connection through an intermediate medium, an internal communication of two elements, or interaction between two elements. For those of ordinary skill in the art, the specific meanings of the above terms in the embodiments of the present application can be understood according to specific situations.

Spray drying refers to a process in which hot air enters a drying tower from a tower opening and makes contact with an atomized material, making the moisture in the material be removed quickly. During the drying process, after the hot air continues to be introduced into the drying tower, the hot air will heat the inside of the drying tower, so that the temperature of the inner wall of the drying tower reaches a certain temperature value. For some temperature-sensitive materials, which may be, for example, but not limited to nanometer electric fuel, feather enzymatic protein, traditional Chinese medicine extract or other materials with a high sugar content, etc., if the material is in contact with the inner wall of the drying tower, it is easy for the material to melt due to high temperature and then adhere to the inner wall of the drying tower, and the phenomenon of the material hanging on the wall occurs. With the increase of the phenomenon of the material hanging on the wall, the amount of the material adhering to the inner wall of the drying tower increases, resulting in a decrease in the amount of the material produced by the drying tower, wasting materials, and resulting in a decrease in the output rate of the product.

At the same time, the material adhering to the inner wall of the drying tower will partly fall off under the blowing of the hot air. Because the particle size of the material which falls off changes after melting, it is generally larger than the particle size of the normally dried material. Therefore, the material which falls off will be mixed into the dried material, affecting the quality of the product in terms of the particle size.

Based on this, in order to effectively reduce the probability of the material hanging on the wall and improve the output rate and granulation quality of the material, please refer to FIG. 1. The present application designs a drying apparatus 100, and a cooling mechanism 20 is disposed on the drying tower 10. The cooling mechanism 20 is used for cooling the inner wall 11 of the drying tower 10. In this way, when the drying tower 10 performs spray drying operation, after the material is in contact with the inner wall 11 of the drying tower 10, the phenomenon that the material melts because of a high temperature of the inner wall 11 and adheres to the inner wall is avoided, which reduces the probability of the material hanging on the wall, thereby improving the production rate and granulation quality of the material.

At the same time, the cooling mechanism 20 is used for cooling the inner wall 11 of the drying tower 10, so that the material is not likely to adhere to the inner wall 11 of the drying tower 10, and the difficulty for cleaning the inner wall 11 of the drying tower 10 is reduced. In addition, if more materials adhere to the inner wall 11 of the drying tower 10, the inner space of the drying tower 10 will be reduced, making the granulation space smaller, which will affect the granulation effect of the device. For this reason, cooling the inner wall 11 through the cooling mechanism 20 can also reduce the probability of the material hanging on the wall, reduce the degree of shrinkage of the inner space of the drying tower 10, and improve the granulation effect of the device.

The drying apparatus 100 provided in the present application can be applied to the spray drying process of different materials, for example, the drying apparatus 100 can be applied to, but not limited to, the spray drying process of the nanometer electric fuel.

According to some embodiments of the present application, please refer to FIG. 1, the present application provides a drying apparatus 100, and the drying apparatus 100 includes: a drying tower 10 and a cooling mechanism 20. The cooling mechanism 20 is disposed on the drying tower 10, and is used for cooling the inner wall 11 of the drying tower 10. The cooling mechanism 20 includes reinforcing members 25 and a cooling member 22 disposed on the outer wall of the drying tower 10, and each reinforcing member 25 is at least partially connected to between the cooling member 22 and the outer wall of the drying tower 10.

The drying tower 10 refers to a device for drying materials, and hot air can be introduced into the drying tower, and the atomized material is dried by using the hot air. The hot air can be input into the drying tower 10 from top to bottom, or from bottom to top; the hot air can even be input from the side face of the drying tower 10. The drying tower 10 can be designed into various shapes, for example: the drying tower can be designed into, but not limited to, cylindrical, conical and cuboid shapes and the like. When the drying tower 10 is designed into a conical structure, the conical part thereof can play a role in converging the dried material to facilitate the uniform output of the material.

It is not difficult to understand that the way for the material to enter the drying tower 10 is usually that the material enters from the top or side face of the drying tower 10, for example, an atomizing nozzle is disposed on the top of the drying tower 10, and the material is atomized and sprayed into the drying tower 10 by using the atomizing nozzle, so that the material is in contact with the hot air.

The cooling mechanism 20 refers to a device capable of cooling the inner wall 11 of the drying tower 10. The cooling mechanism has multiple methods for cooling the inner wall 11 of the drying tower 10, for example, the drying tower 10 is cooled in the way of air cooling or water cooling; or, the drying tower 10 may also be lowered by means of a semiconductor chilling plate. The cooling mechanism 20 can also be arranged on the drying tower 10 in various ways, for example: the cooling mechanism 20 can be arranged on the outer wall of the drying tower 10; or, the cooling mechanism 20 can be embedded in the tower wall of the drying tower 10.

The cooling mechanism 20 can be designed into a plate-shaped structure, such as a water-cooled plate structure, or a tubular structure, such as a cooling water pipe structure.

The cooling member 22 refers to a structure that allows the cooling medium to flow so that the cooling medium can exchange heat with the drying tower 10. The cooling member 22 can be designed into a hollow structure, and the interior thereof can be directly used as the cooling channel 23. The cooling member can also be designed into a plate-shaped or sheet-shaped structure, at this time the outer surface of the cooling member 22 can have a cooling channel, for example: a gap can be formed between the cooling member 22 and the outer wall of the drying tower 10, and the gap can be used as a cooling channel. When the cooling member 22 is designed into a hollow structure, the cooling member can be a tubular structure or hollow plate-shaped structure, where the tubular cooling member 22 can be wound on the outer wall of the drying tower 10.

The reinforcing member 25 refers to the structure connected between the cooling member 22 and the outer wall of the drying tower 10, and there are various modes for connecting the reinforcing member with the cooling member 22 and the drying tower 10 respectively, for example, the reinforcing member 25 can be connected between the cooling member 22 and the drying tower 10 by means of bolted connection, welding, snap-fit, bonding, riveting, pinning or integral molding.

It should be noted that the reinforcing member 25 shown in FIG. 1 is not disposed transversely through the drying tower 10, but surrounds the periphery of the reinforcing member 25 in an annular structure. Certainly, the reinforcing member 25 shown in FIG. 1 is only an embodiment, and should not be interpreted as limiting the protection scope of the scheme, for example: between the cooling member 22 and the drying tower 10, the reinforcing member 25 can be of a blocky structure, and can also be an annular structure, etc. When the reinforcing member 25 is of an annular structure, the reinforcing member 25 is connected between the cooling member 22 and the drying tower 10 in the circumferential direction. The number of the reinforcing member 25 can be one or more. When the number of the reinforcing member 25 is plural, the distribution of all the reinforcing members 25 between the cooling member 22 and the drying tower can also be designed in various ways, for example: some reinforcing members 25 are distributed at intervals in the height direction X of the drying tower 10; or, some reinforcing members 25 are arranged at intervals around the drying tower 10 in the circumferential direction.

When the drying tower 10 performs spray drying operation, after the material is in contact with the inner wall 11 of the drying tower 10, the phenomenon that the material melts because of a high temperature of the inner wall 11 and adheres to the inner wall is avoided. This reduces the probability of the material hanging on the wall, thereby improving the production rate and granulation quality of the material. At the same time, the reinforcing member 25 is disposed between the cooling member 22 and the drying tower 10 to increase the connection strength between the cooling member and the drying tower, making the mounting structure of the cooling member 22 on the drying tower 10 more stable, and facilitating stably cooling the drying tower 10 by a cooling medium in the cooling member 22. At the same time it is also beneficial to increase the strength of the drying tower 10. According to some embodiments of the present application, please refer to FIG. 1, the cooling mechanism 20 further includes a power source 21. The cooling member 22 has a cooling channel 23, and the power source 21 is used for driving the cooling medium to flow in the cooling channel 23.

The power source 21 refers to a device capable of providing power for the cooling medium to flow, which may be a draught fan or a power pump. When the power source 21 is a draught fan, the cooling medium may be air, carbon dioxide, or the like. The air may be the air outside the drying tower 10, and the air outside the drying tower 10 is delivered into the cooling channel 23 in a mode of blowing or suction by the draught fan. When the power source 21 is a power pump, the cooling medium can be tap water, glycerin type cooling liquid, etc.

The power of the power source 21 can be set be adjustable, that is, the power source 21 is a variable frequency adjustable device, so that the inflow volume of the cooling medium can be controlled (such as adjusting the supply air rate of the cooling channel 23) by changing the power of the power source 21 according to the cooling requirements of the inner wall 11 of the drying tower 10. For example, temperature monitoring apparatuses (such as temperature sensors, etc.) can be disposed at a certain distance on the inner wall 11 of the drying tower 10 to detect the temperature changes in different regions on the inner wall 11 of the drying tower 10 in real time, so as to adjust the amount of cold air that is introduced. In addition, if too much cooling medium is introduced, it will also cause dew condensation on the inner wall 11 of the drying tower 10. For this, the frequency of the power source 21 can also be changed to reduce the inflow volume of the cooling medium to reduce the occurrence of dew condensation on the inner wall 11.

The power source 21 is used for driving the cooling medium to flow in the cooling channel 23, so as to enable the cooling medium to exchange heat with the drying tower 10, the effect of cooling the inner wall 11 of the drying tower 10 is realized, and the occurrence of the material hanging on the wall is reduced.

According to some embodiments of the present application, please refer to FIG. 1, the cooling member 22 is annularly disposed on the periphery of the drying tower 10, and the cooling channel 23 is formed between the cooling member and the outer wall of the drying tower 10.

The cooling member 22 is annularly disposed on the periphery of the drying tower 10. It can be understood that the cooling member 22 surrounds the outside of the drying tower 10, and forms a certain gap from the outer wall of the drying tower 10. The gap is directly used as the cooling channel 23, so that the cooling medium and the outer wall of the drying tower 10 are in direct contact, so that the heat exchange effect is better.

At the same time, the cooling member 22 is annularly disposed outside the drying tower 10, and there are various ways for fixing the cooling member. For example, the cooling member 22 is fixed to the outer wall of the drying tower 10 by means of bolted connection, welding, snap-fit, riveting and the like.

The cooling member 22 surrounds the outside of the drying tower 10, so that the cooling channel 23 is formed between the cooling member 22 and the drying tower 10, and then the cooling medium flows directly on the outer wall of the drying tower 10, which is conducive to improving the heat exchange effect.

According to some embodiments of the present application, please refer to FIG. 1, the cooling mechanism 20 further includes a flow equalizer 26 annularly disposed on the periphery of the drying tower 10. The inflow end of the cooling channel 23 communicates with the flow equalizer 26, and the power source 21 is used for driving the cooling medium in the flow equalizer 26 to flow into the cooling channel 23.

The flow equalizer 26 refers to a device that can evenly disperse the cooling medium so that the cooling medium flows into the cooling channel 23 more uniformly. When the cooling medium enters the flow equalizer 26 under the action of the power source 21, since the flow equalizer 26 is a structure annularly disposed on the periphery of the drying tower 10, the cooling medium which enters surrounds the periphery of the drying tower 10 to flow in the flow equalizer 26, so that the cooling medium is dispersed before entering the cooling channel 23. Specifically, in some embodiments, the flow equalizer 26 can be designed into an annular and hollow box body structure.

The inflow end of the cooling channel 23 refers to the end on the cooling channel 23 where the cooling medium starts to flow in. Since the cooling channel 23 is formed by the cooling member 22 annularly disposed on the periphery of the drying tower 10, the inflow end of the cooling channel 23 also presents or approximately presents an annular end. When the inflow end of the cooling channel 23 communicates with the flow equalizer 26, it is not difficult to understand that the inflow end of the cooling channel 23 should be in annular communication with the flow equalizer 26, that is, a communication port between the cooling channel 23 and the flow equalizer 26 is disposed around the periphery of the drying tower 10, so that the cooling medium filled in the flow equalizer 26 can flow into the cooling channel 23 synchronously in different directions, and then the cooling medium is evenly dispersed in the cooling channel 23.

When the power source 21 is a blowing type device, the power source 21 can be communicated with the cooling channel 23 through the flow equalizer 26; when the power source 21 is a suction type device, the flow equalizer 26 communicates with the inflow end of the cooling channel 23, and the power source 21 then communicates with the outflow end of the cooling channel 23.

The flow equalizer 26 is disposed at the inflow end of the cooling channel 23, and the cooling medium is evenly dispersed into the cooling channel 23 by the flow equalizer 26, so that the temperature distribution of the inner wall 11 of the drying tower 10 is more uniform, and the occurrence of the material hanging on the wall is further reduced; at the same time, it is also beneficial to improve the granulation quality of the material.

According to some embodiments of the present application, please refer to FIG. 1, the cooling mechanism 20 further includes reinforcing members 25, and each reinforcing member 25 is at least partially connected between the cooling member 22 and the outer wall of the drying tower 10.

Figure 2:
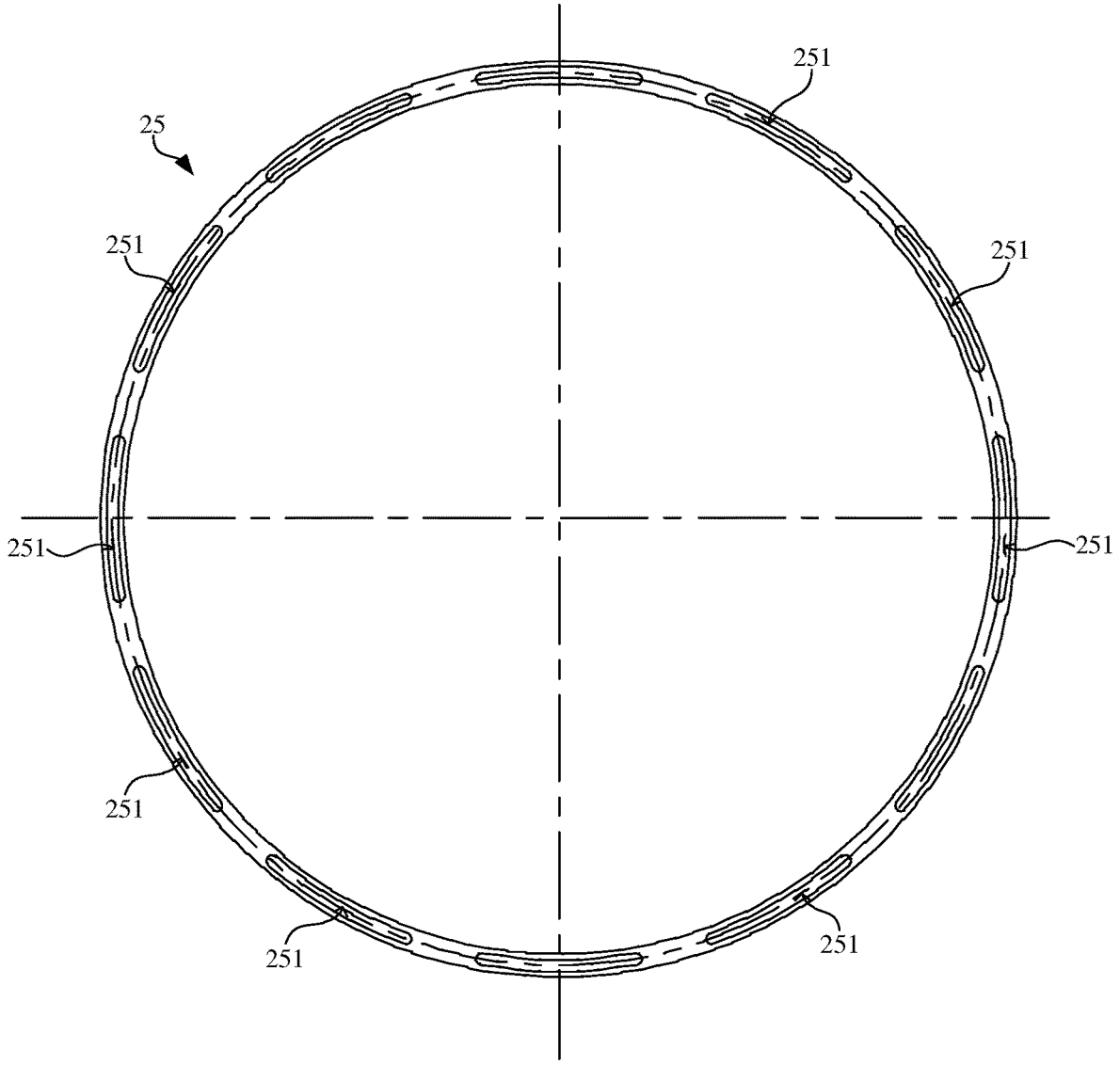
FIG. 2 is a schematic structural view of a reinforcing member in FIG. 1.

According to some embodiments of the present application, please refer to FIG. 2, the reinforcing member 25 is annularly disposed on the periphery of the drying tower 10, and the part of the reinforcing member 25 located in the cooling channel 23 is provided with a circulating port 251, the circulating port 251 being used for the cooling medium of the cooling channel 23 to circulate.

The reinforcing member 25 extends around the periphery of the drying tower 10 to form an annular structure. Since the reinforcing member 25 is located between the cooling member 22 and the drying tower 10, the annularly designed reinforcing member 25 will hinder the flow of the cooling medium to a certain extent. In order to make the cooling medium flow smoothly, the circulating port 251 penetrates through the reinforcing member 25 so that the cooling medium can pass through the reinforcing member 25 through the circulating port 251 to flow in the cooling channel 23.

On the same reinforcing member 25, the number of the circulating ports 251 can be one or more. When the number of the circulating ports 251 is plural, all the circulating ports 251 are arranged on the reinforcing member 25 at intervals around the periphery of the drying tower 10.

The circulating port 251 penetrates through the reinforcing member 25, so that the cooling medium can pass through the reinforcing member 25 to flow smoothly in the cooling channel 23, thereby improving the cooling effect of the drying tower 10.

Figure 3:
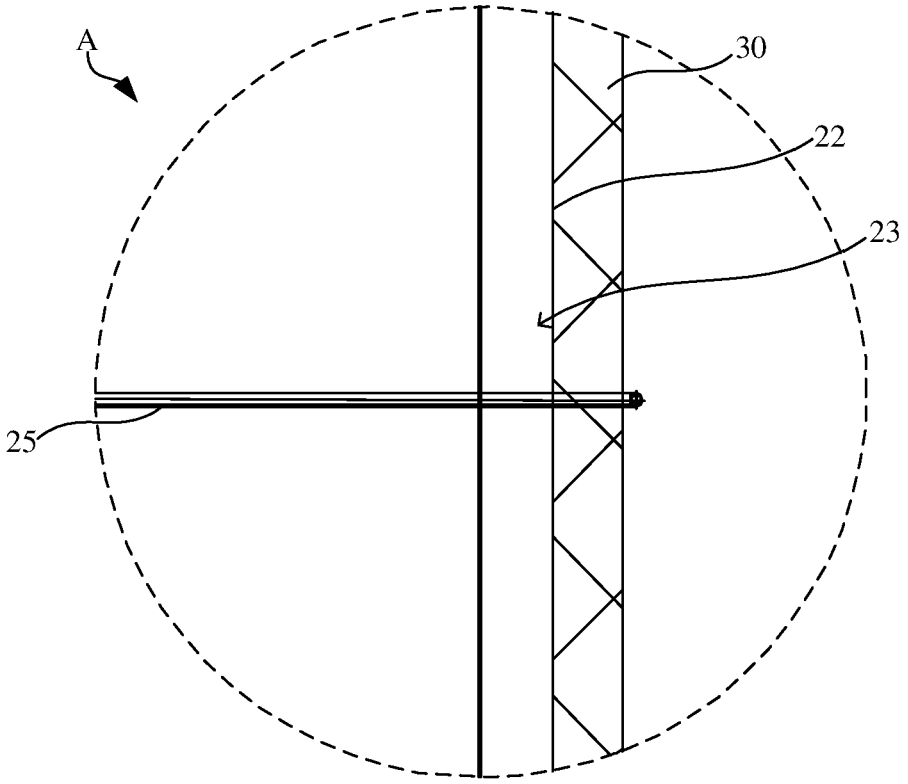
FIG. 3 is a partially enlarged schematic view of position A in FIG. 1.

According to some embodiments of the present application, please refer to FIG. 3, one end of the reinforcing member 25 away from the drying tower 10 in the radial direction of the drying tower 10 penetrates out of the cooling member 22.

One end of the reinforcing member 25 penetrating out of the cooling member 22 should be understood as one end of the reinforcing member 25 is embedded into the cooling member 22 and protrudes from the inside of the cooling member 22. When one end of the reinforcing member 25 penetrates out of the cooling member 22, it is necessary to seal the part where the reinforcing member 25 penetrates into the cooling member 22, such as performing welding and coating sealant between the cooling member 22 and the reinforcing member 25. When a thermal insulation structure is disposed outside the cooling member 22, the end of the reinforcing element 25 away from the drying tower 10 can penetrate through the cooling member 22 and can also penetrate through the thermal insulating structure. In addition, when the reinforcing member 25 is designed into an annular structure, the end of the reinforcing member 25 away from the drying tower 10 can also be understood as the outer side end of the annular structure.

One end of the reinforcing member 25 penetrates out of the cooling member 22, so that the connection area between the reinforcing member 25 and the cooling member 22 increases, which is conducive to improving the connection strength; at the same time, the part of the reinforcing member 25 penetrating into the cooling member 22 can be used as a supporting base, so that the cooling member 22 is more stably mounted on the drying tower 10.

According to some embodiments of the present application, the drying tower 10 has an air outlet 12. The cooling member 22 extends on the outer wall of the drying tower 10 to be adjacent to the air outlet 12.

During the drying process, it is very important to control the inlet air temperature and the outlet air temperature of the hot air, which can determine the quality of the product and the drying bulk density, so these two temperatures need to be strictly controlled. The cooling member 22 is extended to the air outlet 12, that is, the cooling flow channel is extended to the air outlet 12, so that the cooling at the air outlet 12 can be increased, and the outlet air temperature can be reduced to meet the process requirements.

The cooling member 22 is extended to the air outlet 12, cooling at the air outlet 12 is increased, and the outlet air temperature is reduced to meet the process requirements.

According to some embodiments of the present application, please refer to FIG. 1, the drying tower 10 includes a first part 13 and a second part 14 having the air outlet 12. The cross-sectional area S in the second part 14 gradually decreases from one end of the second part 14 close to the first part 13 to one end of the second part 14 having the air outlet 12. The cooling member 22 is disposed on the first part 13 and extends to the second part 14.

The cross-sectional area S in the second part is smaller as it gets closer to the air outlet 12, which shows that the second part is of a structure with the top larger and the bottom smaller. For example, the second part is conically designed, etc., which can facilitate uniformly collecting and discharging the dried material.

Extending the cooling member 22 to the second part 14 can increase the cooling of the second part, so that the outlet air temperature of the drying tower 10 can be lowered, further meeting the process requirements.

According to some embodiments of the present application, please refer to FIG. 1, the cooling mechanism 20 further includes a discharge member 24 disposed on the drying tower 10. The discharge member 24 has discharge ports 241 communicating with the cooling channel 23.

The discharge member 24 may be disposed at the top of the drying tower 10, or at the bottom of the drying tower 10, or the like. When the discharge member 24 is disposed at the top of the drying tower 10, the cooling medium can be input from the bottom of the drying tower 10, and the flow direction of the cooling medium is generally from bottom to top. The top and the bottom of the drying tower 10 can be understood respectively: when the drying tower 10 is in normal operation, the higher end of the drying tower 10 in the vertical direction is the top, and the relatively lower end is the bottom.

The method for mounting the discharge member 24 on the drying tower 10 may be, but not limited to, bolt connection, snap-fit, riveting, welding, bonding and the like. There are many ways to communicate the discharge port 241 with the cooling channel 23. For ease of understanding, the discharge member 24 disposed on the top of the drying tower 10 is taken as an example for illustration, and the discharge member 24 can be disposed on the top of the drying tower 10 at intervals, so that a channel is formed between the discharge member 24 and the top of the drying tower 10. Then, the cooling member 22 surrounds the periphery of the discharge member 24 and is connected, so that an integral cover or hood structure can be formed between the discharge member 24 and the cooling member 22, and is directly disposed on the drying tower 10 in a sleeving mode, at this time, the cooling channel 23 on the cooling member 22 communicates with the channel between the discharge member 24 and the top of the drying tower 10; or, the discharge member 24 is disposed on the top of the drying tower 10 in a covering mode; then, the cooling member 22 is annularly disposed on the side face of the drying tower 10, and one end of the cooling member 22 is extended to be disposed on the periphery of the discharge element 24 in a surrounding mode. At this time, an opening communicating with the inside of the discharge member can be formed in the discharge member 24 (at this time, the discharge member 24 can be of a hollow structure), so that the opening communicates with the cooling channel 23 between the cooling member 22 and the drying tower 10, thereby making the cooling channel 23 keep communicating with the discharge port 241. Specifically, in some embodiments, an integral structure is formed between the discharge member 24 and the cooling member 22, which is integrally disposed on the outer wall of the drying tower 10 in a sleeving mode. In addition, the discharge member 24 is disposed on the top of the drying tower 10, which can serve as a device support, for example, a spray head of the drying tower 10 can be supported to be mounted, maintenance personnel can climb to the top of the tower for maintenance and so on.

The discharge member 24 is disposed so that the cooling medium flows out from the discharge port 241, which facilitates the continuous flow of a new cooling medium into the cooling channel 23 and improves the cooling effect of the drying tower 10.

According to some embodiments of the present application, please refer to FIG. 1, the number of the discharge ports 241 is at least two, and the discharge ports 241 are all disposed at intervals around the periphery of the drying tower 10.

The number of the discharge port 241 and the distance between two adjacent discharge ports 241 may be determined according to the actual cooling requirements, and are not specifically limited here. At the same time, when the discharge ports 241 are arranged at intervals around the periphery of the drying tower 10, one circle of discharge ports 241 may be disposed, or a plurality of circles of discharge ports 241 distributed up and down may be disposed. Specifically, in some embodiments, the discharge ports 241 on the discharge member 24 may be distributed on the periphery of the drying tower 10 at equal intervals, so that the cooling medium is discharged more uniformly.

The discharge ports 241 are disposed at intervals around the periphery of the drying tower 10, so that the cooling medium in the cooling channel 23 flows out from different discharge ports 241, which is conducive to changing the flow path of the cooling medium in the cooling channel 23, making the distribution of the cooling medium more uniform, and improving the cooling effect.

According to some embodiments of the present application, please refer to FIG. 1, the drying apparatus 100 further includes a thermal insulation layer 30, and the thermal insulation layer 30 is disposed outside the cooling member 22 in a sleeving mode.

The thermal insulation layer 30 refers to a structure that can reduce the heat transfer rate, for example, it can be, but not limited to, an asbestos layer, a silicate layer, a rock wool layer, an expanded perlite layer and the like. There are many ways to connect the thermal insulation layer 30 on the cooling member 22, for example, it may be, but not limited to, bolted connection, bonding, welding, snap-fit and the like.

The thermal insulation layer 30 is disposed outside the cooling member 22, reducing the heat loss in the cooling channel 23, and enabling the cooling medium to fully exchange heat with the drying tower 10, so that the inner wall 11 of the drying tower 10 can maintain the required temperature for a long time, and the probability of the material adhering to the wall due to the too high temperature of the inner wall 11 is reduced.

Figure 4:
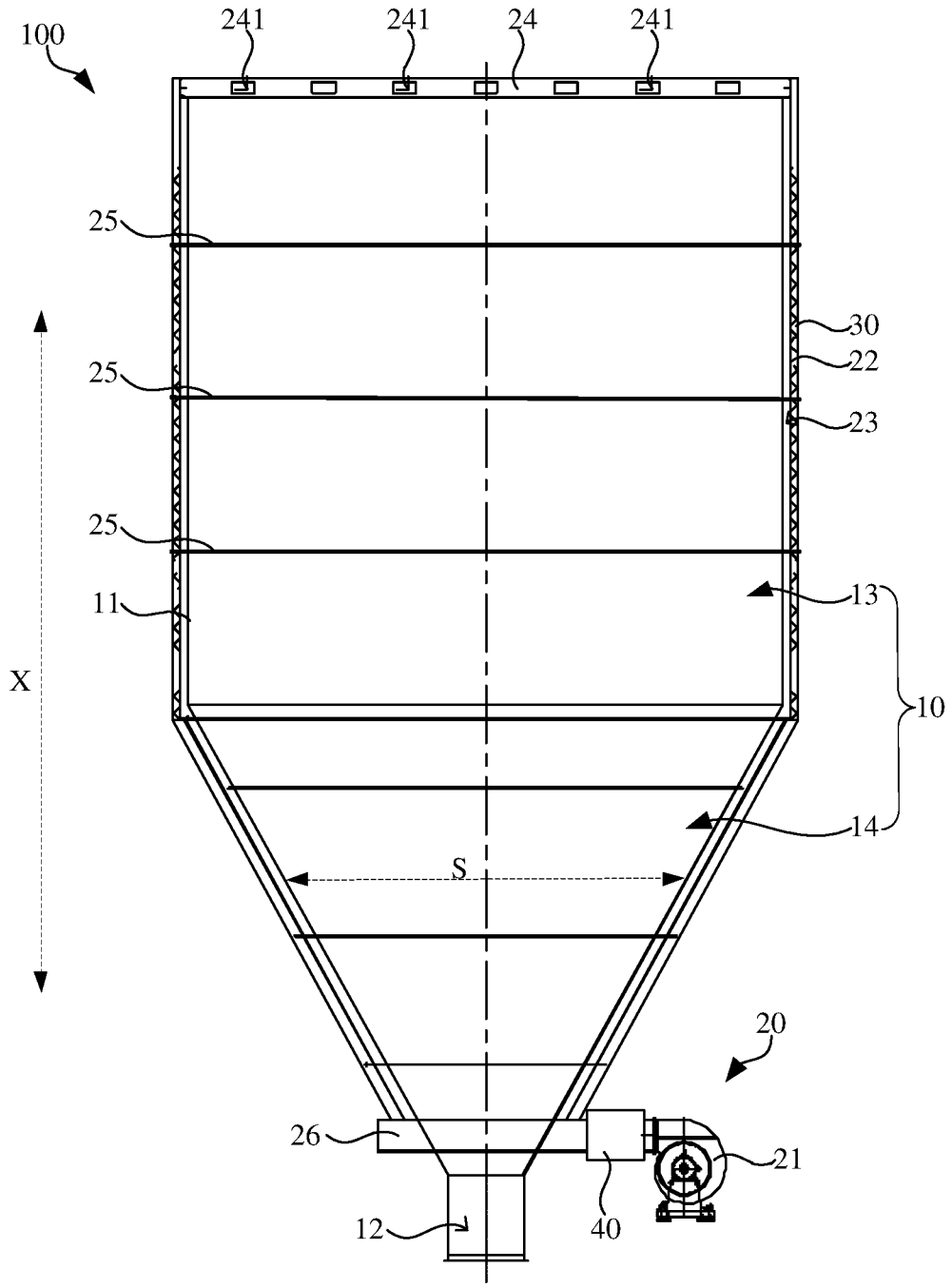
FIG. 4 is a schematic structural view of a drying apparatus with a heat exchanger according to one or more embodiments.

According to some embodiments of the present application, please refer to FIG. 4, the drying apparatus 100 further includes a heat exchanger 40, and the heat exchanger 40 communicates with one end of the cooling member 22 for the cooling medium to flow in.

The heat exchanger 40 refers to a device capable of exchanging heat with the cooling medium, for example, the heat exchanger can be designed into a structure such as a cooling fin. When the temperature of the cooling medium (such as normal temperature air, etc.) cannot meet the cooling requirement, the heat exchanger 40 can be connected to the input end of the cooling channel 23 to reduce the temperature of the cooling medium. When the power source 21 is a blowing type fan, the heat exchanger 40 can be communicated between the power source 21 and one end of the cooling member 22 for the cooling medium to flow in. It should be noted that when the flow equalizer 26 is connected to the end of the cooling member 22 for the cooling medium to flow in, the heat exchanger 40 can communicate with one end of the cooling member 22 through the flow equalizer 26.

The heat exchanger 40 exchanges heat with the cooling medium in advance to change the temperature of the cooling medium so that the cooling medium can better meet the cooling requirement of the inner wall 11 of the drying tower 10.

According to some embodiments of the present application, the present application further provides a system for preparing batteries, including any one of the above drying apparatuses 100.

According to some embodiments of the present application, please refer to FIG. 1 to FIG. 4, the present application provides a drying apparatus 100, a cooling member 22 is disposed between the drying tower 10 and the thermal insulation layer 30, and air is blown from the bottom of the cooling member 22, and normal temperature air with the temperature lower than the temperature of the drying tower 10 is introduced to cool the inner wall 11. The thermal insulation layer 30 is disposed outside the cooling member 22 to keep the inner wall 11 at the required temperature for a long time, so that the material will not melt when making contact with the inner wall 11. In addition, a plurality of annular reinforcing members 25 are welded between the drying tower 10 and the cooling member 22. A power source 21 (such as a draught fan) is mounted at the bottom of the drying tower 10 to pump the normal temperature air into the cooling channel 23 to reach the top of the drying tower 10 through a circulating port 251 in the reinforcing member 25, and the top of the drying tower is provided with discharge ports 241 to discharge hot air.

Finally, it should be noted that the above various embodiments are merely used for illustrating rather than limiting the technical solutions of the present application. Although the present application has been described in detail with reference to the above various embodiments, those of ordinary skill in the art should understand that the technical solutions specified in the above various embodiments can still be modified, or some or all of the technical features therein can be equivalently substituted; and such modifications or substitutions do not make the essence of the corresponding technical solutions depart from the scope of the technical solutions of the various embodiments of the present application, which shall fall within the scope of the claims and the specification of the present application. In particular, the technical features mentioned in the various examples can be combined in any manner as long as there is no structural conflict. The present application is not limited to the specific embodiments disclosed herein, but rather includes all technical solutions falling within the scope of the claims.

The technical features of the above examples can be combined arbitrarily. In order to make the description concise, not all possible combinations of the technical features in the above examples are described. However, all the combinations of the technical features should be considered as falling within the scope described in this specification provided that they do not conflict with each other.

The above embodiments only describe several implementation modes of the present application, and the description thereof is specific and detailed, but cannot therefore be understood as a limitation on the patent scope of the present application. It should be noted that those of ordinary skill in the art may further make several variations and improvements without departing from the concept of the present application, all of which fall within the protection scope of the present application. Therefore, the patent protection scope of the present application should be subject to the appended claims.

What is claimed is:

1. A drying apparatus, comprising:

a drying tower, having an air outlet through which hot air is blown into the drying tower to contact and dry an atomized material; and a cooling mechanism, disposed on the drying tower, for cooling an inner wall of the drying tower;

wherein the cooling mechanism comprises a reinforcing member and a cooling member disposed on an outer wall of the drying tower, and the reinforcing member is at least partially connected between the cooling member and the outer wall of the drying tower; and wherein the drying apparatus is configured to dry a nanoelectrochemical fuel for preparation of batteries.

2. The drying apparatus according to claim 1, wherein the cooling mechanism further comprises a power source, the cooling member has a cooling channel, and the power source is used for driving a cooling medium to flow in the cooling channel.

3. The drying apparatus according to claim 2, wherein the cooling member is annularly disposed on a periphery of the drying tower, and the cooling channel is formed between the cooling member and the outer wall of the drying tower.

4. The drying apparatus according to claim 3, wherein the cooling mechanism further comprises a flow equalizer annularly disposed on the periphery of the drying tower, an inflow end of the cooling channel communicates with the flow equalizer, and the power source is used for driving the cooling medium in the flow equalizer to flow into the cooling channel.

5. The drying apparatus according to claim 2, wherein the reinforcing member is annularly disposed on a periphery of the drying tower, and a part of the reinforcing member located in the cooling channel is provided with a circulating port, the circulating port being used for the cooling medium of the cooling channel to circulate.

6. The drying apparatus according to claim 1, wherein one end of the reinforcing member away from the drying tower in a radial direction of the drying tower penetrates out of the cooling member.

7. The drying apparatus according to claim 1, wherein the drying tower comprises a first part and a second part having the air outlet, a cross-sectional area S in the second part gradually decreases from an end of the second part close to the first part to an end of the second part having the air outlet, and the cooling member is disposed on the first part and extends to the second part.

8. The drying apparatus according to claim 2, wherein the cooling mechanism further comprises a discharge member disposed on the drying tower, and the discharge member has discharge ports communicating with the cooling channel.

9. The drying apparatus according to claim 8, wherein a quantity of the discharge ports is at least two, and the discharge ports are all disposed at intervals around a periphery of the drying tower.

10. The drying apparatus according to claim 1, wherein the drying apparatus further comprises a thermal insulation layer, and the thermal insulation layer is disposed outside the cooling member in a sleeving mode.

11. The drying apparatus according to claim 1, wherein the drying apparatus further comprises a heat exchanger, and the heat exchanger communicates with one end of the cooling member for a cooling medium to flow in.

12. A system for preparing batteries, comprising the drying apparatus according to claim 1.

* * * * *